US009784096B2

(12) United States Patent
Menezes et al.

(10) Patent No.: US 9,784,096 B2
(45) Date of Patent: Oct. 10, 2017

(54) EXPANDED MUD PULSE TELEMETRY

(71) Applicant: Halliburton Energy Services, Inc., Houston, TX (US)

(72) Inventors: Clive Menezes, Conroe, TX (US); James Randolph Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 14/440,534

(22) PCT Filed: Dec. 28, 2012

(86) PCT No.: PCT/US2012/072038
§ 371 (c)(1),
(2) Date: May 4, 2015

(87) PCT Pub. No.: WO2014/105049
PCT Pub. Date: Jul. 3, 2014

(65) Prior Publication Data

US 2015/0275658 A1 Oct. 1, 2015

(51) Int. Cl.
*E21B 47/18* (2012.01)
*E21B 47/06* (2012.01)
(Continued)

(52) U.S. Cl.
CPC ..... *E21B 47/18* (2013.01); *E21B 21/08* (2013.01); *E21B 21/106* (2013.01); *E21B 47/06* (2013.01)

(58) Field of Classification Search
CPC ..... E21B 47/187; E21B 47/185; E21B 47/18; E21B 21/08; E21B 21/106; E21B 47/06
See application file for complete search history.

(56) References Cited

U.S. PATENT DOCUMENTS

H55 H * 5/1986 Ramsey ..... E21B 47/18 367/83
5,660,238 A 8/1997 Earl et al.
(Continued)

FOREIGN PATENT DOCUMENTS

EA 2008/70156 12/2008
EA 2009/70408 10/2009
(Continued)

OTHER PUBLICATIONS

Office Action received for Russian Application No. 2015120075, with English Translation, mailed Jun. 3, 2016; 10 pages.
(Continued)

*Primary Examiner* — Yong-Suk (Philip) Ro
(74) *Attorney, Agent, or Firm* — Baker Botts L.L.P.

(57) ABSTRACT

The present disclosure provides systems and methods for expanded mud pulse telemetry. Certain methods provided include measuring pressure proximate at least one of first and second pressure control modules along a drilling apparatus and telemetering the measured pressure to a surface controller. A command is transmitted from the surface controller to at least one of the first and second pressure control modules or one of first and second controllable flow restrictors via mud pulse telemetry while mud is not being pumped through a main standpipe.

19 Claims, 3 Drawing Sheets

(51) Int. Cl.
*E21B 21/08* (2006.01)
*E21B 21/10* (2006.01)

(56) References Cited

U.S. PATENT DOCUMENTS

| | | | | |
|---|---|---|---|---|
| 6,158,533 | A | 12/2000 | Gillis et al. | |
| 6,328,119 | B1 | 12/2001 | Gillis et al. | |
| 6,378,363 | B1 | 4/2002 | Hache et al. | |
| 7,775,299 | B2 | 8/2010 | Khan et al. | |
| 7,836,973 | B2 | 11/2010 | Belcher et al. | |
| 8,016,033 | B2 | 9/2011 | Iblings et al. | |
| 2002/0159333 | A1* | 10/2002 | Hahn | E21B 47/18 367/83 |
| 2003/0016164 | A1* | 1/2003 | Finke | E21B 47/185 342/83 |
| 2003/0026167 | A1* | 2/2003 | Hahn | E21B 47/18 367/38 |
| 2004/0065477 | A1 | 4/2004 | Paulk | |
| 2004/0159467 | A1 | 8/2004 | Ayling | |
| 2005/0194184 | A1 | 9/2005 | Gleitman | |
| 2006/0124352 | A1 | 6/2006 | Krueger et al. | |
| 2007/0007041 | A1 | 1/2007 | Krueger et al. | |
| 2007/0247328 | A1* | 10/2007 | Petrovic | G01V 11/002 340/853.7 |
| 2007/0258327 | A1* | 11/2007 | Harvey | E21B 47/187 367/85 |
| 2008/0002524 | A1* | 1/2008 | Wassermann | E21B 47/18 367/83 |
| 2009/0166031 | A1 | 7/2009 | Hernandez | |
| 2011/0011594 | A1* | 1/2011 | Young | E21B 47/187 166/321 |
| 2011/0214920 | A1 | 9/2011 | Vail et al. | |
| 2013/0008647 | A1 | 1/2013 | Dirksen et al. | |
| 2013/0008648 | A1 | 1/2013 | Lovorn et al. | |
| 2013/0080063 | A1* | 3/2013 | Pillai | E21B 47/18 702/9 |

FOREIGN PATENT DOCUMENTS

| | | |
|---|---|---|
| WO | 86/55543 | 9/1986 |
| WO | 2007/081711 | 7/2007 |
| WO | 2008/051978 | 5/2008 |
| WO | 2011/119668 | 9/2011 |
| WO | 2011/119675 | 9/2011 |

OTHER PUBLICATIONS

Office Action received for Canadian Application No. 2891215, mailed May 12, 2016; 4 pages.
Office Action received for Australian Application No. 2012397850, mailed Mar. 29, 2016; 3 pages.
Office Action received for Australian Application No. 2012397850, mailed Jun. 29, 2016; 3 pages.
Office Action received for Thailand Application No. 1501002947, mailed Aug. 17, 2016; 2 pages.
International Preliminary Report on Patentability, Application No. PCT/US2012/072038; 7 pages, Jun. 30, 2015.
Office Action, Australian Application No. 2012397850; 3 pages, Dec. 22, 2015.
European Search Report, Application No. 12891100.5; 8 pages, Sep. 16, 2016.
Office Action received for Mexican Patent Application No. MX/a/2015/006678, dated Mar. 6, 2017; 3 pages.
International Search Report and Written Opinion, Application No. PCT/US2012/072038, 9 pages, dated Mar. 12, 2013.

* cited by examiner

EXPANDED MUD PULSE TELEMETRY

RELATED APPLICATION

This application is a U.S. National Stage Application of International Application No. PCT/US2012/072038 filed Dec. 28, 2012, which designates the United States, and which is incorporated herein by reference in its entirety.

BACKGROUND

The present disclosure relates generally to well drilling operations and, more particularly, to expanded mud pulse telemetry.

In well drilling operations, mud pulse telemetry is an important means of communication from the surface to down-hole components. Additionally, down-hole pressure can be an important characteristic to monitor and/or control. For example, if down hole pressure is too low, formation fluid may flow back up a drill string, possibly resulting in a blowout. In a specific instance, fluid from a high pore pressure formation may move through the wellbore to a low pore pressure formation causing an underground blowout. Efforts to control pressure along the drill string in addition to the bottom hole pressure may be referred to as managed pressure drilling (MPD). Efforts have also been developed to allow the controlled influx of formation fluids during drilling by keeping the drilling pressure profile below the formation pore pressure. Such drilling may be referred to as underbalanced drilling (UBD).

FIGURES

Some specific exemplary embodiments of the disclosure may be understood by referring, in part, to the following description and the accompanying drawings.

Figure 1:
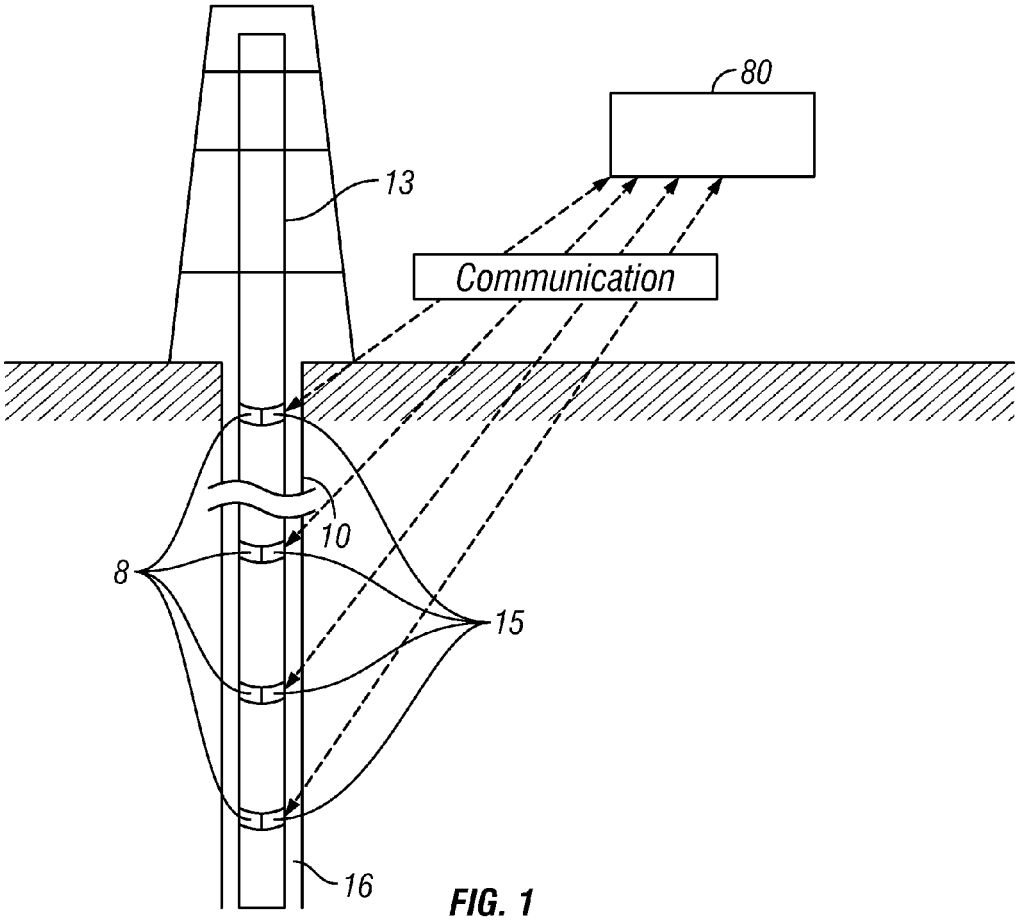
FIG. 1 illustrates an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF EXAMPLE EMBODIMENTS

The present disclosure relates generally to well drilling operations and, more particularly, to for expanded mud pulse telemetry.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

According to aspects of the present disclosure, systems and methods for pressure readings in pipe connection periods are described herein. The system may comprise a drill string including a plurality of pressure control modules along the length of the drill string. The pressure control modules may be in communication with a surface controller configured to monitor the pressure gradient along the length of the drill string. The drill string may further include controllable flow restrictors which the surface controller may communicate with and direct in order to control the pressure gradient along the drill string. This monitoring and/or control may continue while connections are made or broken to extend or retract the length of the drill string.

FIG. 1 illustrates an example of a drilling system according to some embodiments of the present disclosure. FIG. 1 shows a drilling apparatus comprising a drill string 13 extending into wellbore 10. Additionally, there may be an annulus 16 between drill string 13 and wellbore 10. As used herein, the term "annulus" may refer to a space between two generally concentric objects. Drill string 13 may include one or more pressure control modules 15. These pressure sensor modules may include a controllable flow restrictor 8, or may be located proximate and be in communication with one or more controllable flow restrictors 8. Pressure sensor modules 15 may be in communication with a surface controller 80, either directly or indirectly. For example, each pressure control module 15 may be configured to communicate with surface controller 80, or other components may act as a communication intermediary for either direction of communication.

Drill string 13 may be made up of a series of individual lengths of pipe or other tubing joined together. For example, a first threaded piece of pipe may enter wellbore 10, followed by a second piece of threaded pipe attached via the threads to the first piece of pipe and fed into wellbore 10. A third threaded piece of pipe may then be attached to the second piece of pipe and fed into wellbore 10. In this way, drill string 13 may be variable to nearly any length by adding or removing individual lengths of pipe or tubing. While threads are used as an example of connection means for joining the individual components of drill string 13, it will be appreciated that any of a variety of connecting means may be used, for example, a compression fit or tension fit. A variety of threads, seals, gaskets, or other features or components may also be used to facilitate the connection. Drill string 13 may also be a single, continuous piece of tubing or pipe, rather than a series of individual pieces that are connected together.

As used herein, the term drilling fluid will be understood to be synonymous with drilling mud, referring to any of a number of liquid, gaseous, and/or solid mixtures and/or emulsions used in operations to drill boreholes. As used herein, the term pressure profile will be understood to refer to overall pressure values for a given region. For example, a pressure profile along drill string 13 may refer to the overall representation or understanding of pressure at various points along the length of drill string 13.

Figure 2:
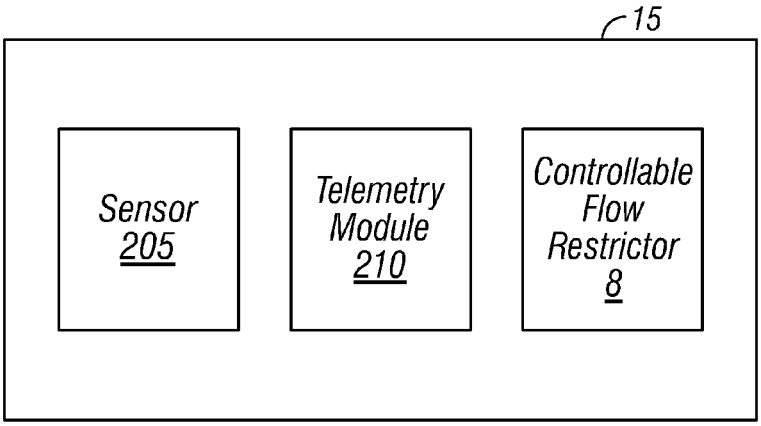
FIG. 2 illustrates an example pressure control module, according to aspects of the present disclosure.

As shown in FIG. 2, pressure control module 15 may comprise a sensor 205, a telemetry module 210, and a controllable flow restrictor 8. While the various components are shown distinctly, it will be appreciated that this may merely be for ease of understanding and may only represent logical designations rather than physical distinctions. For example, the entire pressure control module 15 may be implemented as a single mechanical or electrical device, for example, an application-specific integrated circuit (ASIC) or microcontroller, or each shown component may be comprised of a variety of sub-components. Some components may merely be functional features of the same physical device, but need not be. Additionally, sensor 205, telemetry module 210, and controllable flow restrictor 8 are not necessary components of pressure control module 15, but may be included.

Sensor 205 may be any suitable mechanical, electrical, or other component configured to measure pressure proximate the pressure control module 15 along drill string 13. For example, in some embodiments, pressure control module 15 may measure the pressure of annulus 16 between drill string 13 and wellbore 10. Additionally, pressure control module 15 may be configured to measure the pressure within drill string 13. The pressure readings may be used to monitor the pressure gradient along annulus 16 and may further be used to construct a pressure profile along drill string 13.

Telemetry module 210 may be any suitable mechanical or electrical component or group of components configured to communicate with other components of the drilling system. For example, telemetry module 210 may communicate measured pressure data to other components like surface controller 80. Telemetry module 210 may also receive signals from other components. For example, telemetry module 210 may receive commands directed to controllable flow restrictor 8. In some embodiments, telemetry module 210 may be implemented as a processor, application-specific integrated circuit (ASIC), field-programmable gate array (FPGA), microcontroller, or other software, hardware, logic or other means configured to facilitate telemetry module 210 communicating with other components of the drilling system.

Controllable flow restrictor 8 may be configured to alter the flow of drilling fluid returning along annulus 16. For example, controllable flow restrictor 8 may be a mechanical device that is configured to either restrict or liberate the flow of the drilling fluid in annulus 16. In some embodiments, controllable flow restrictor 8 may be a spiral stabilizer configured to stabilize the drill string and further configured to rotate to increase or decrease flow rates past the spiral stabilizer. In some embodiments, controllable flow restrictor 8 may be located proximate pressure control module 15, rather than being part of pressure control module 15. In such embodiments, controllable flow restrictor 8 may be in communication with pressure control module 15, but need not be. The controllable flow restrictors may be used to control the equivalent circulating density of the drilling fluid along the annulus.

Pressure control modules 15 and/or controllable flow restrictors 8 may be used to precisely control the annular pressure profile throughout the wellbore. For example, they may be used to ascertain the down hole pressure environment limits and to manage the annular hydraulic pressure profile accordingly. For example, in managed pressure drilling, the annular hydraulic pressure profile may be controlled between the pore pressure and the fracture pressure of the formation along the wellbore. Alternatively, the pressure control modules 15 and controllable flow restrictors may be used in underbalanced drilling. For example, the pressure profile may be controlled below the formation pore pressure such that there is a controlled fluid influx from the formation, such as an influx of oil or other hydrocarbons.

Figure 3:
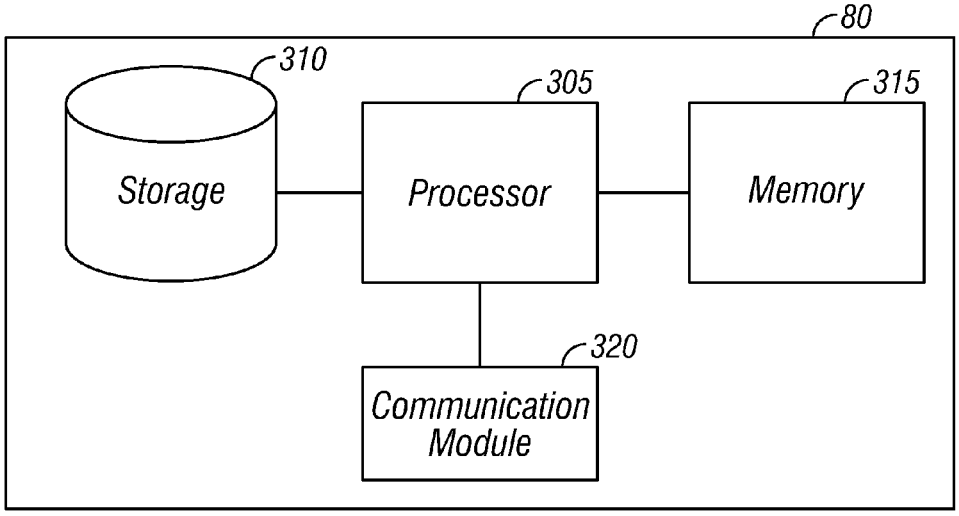
FIG. 3 illustrates an example surface controller, according to aspects of the present disclosure.

With reference to FIG. 3, surface controller 80 may comprises a processor 305, storage media 310, memory 315, and a communication module 320. Surface controller 80 may be implemented as a processor, application-specific integrated circuit (ASIC), field-programmable gate array (FPGA), microcontroller, or other software, hardware, logic or other means configured to facilitate surface controller 80 communicating with drill string 13. In some embodiments, the various components of surface controller 80 are merely logical designations, and surface controller 80 may physically be merely one or more components. For example, surface controller 80 may be a single microcontroller or ASIC. As an alternative example, memory 315 and storage media 310 may be logical representations of the same physical component or components.

Processor 305 includes any hardware and/or software that operates to control and process information. Processor 305 may be a programmable logic device, a microcontroller, a microprocessor, FPGA, ASIC, any suitable processing device, or any suitable combination of the preceding. Processor 305 may be configured to perform analyses, calculations, or other logic, involving any measured pressure data. Processor 305 may further be configured to issue commands or directions to other components. These commands may or may not be based on an analysis performed by processor 305.

Storage media 310 and/or memory 315 may be any computer-readable medium that stores, either permanently or temporarily, data. Storage media 310 and/or memory 315 may include any one or a combination of volatile or non-volatile local or remote devices suitable for storing information. For example, storage media 310 and/or memory 315 may include random access memory (RAM), read only memory (ROM), flash memory, magnetic storage devices, optical storage devices, network storage devices, cloud storage devices, or any other suitable information storage device or a combination of these devices. Storage media 310 may be used for long term storage and memory 315 may be configured to store data to be readily used by processor 305.

Communication module 320 may be any component or components configured to facilitate communication between surface controller 80 and other components of the drilling system, including but not limited to drill string 13. Communication module 320 may employ different components for different means of communication. For example, when mud pulse telemetry may be used, communication module 320 may utilize pressure sensors and/or one or more surface pulsers. When direct-wired pipe may be used, communication module 320 may comprise an electronic interface to receive and transmit electronic signals to the electronic system within drillstring 13. When electromagnetic telemetry is used, communication module may include an electromagnetic transmitter for transmitting signals to drillstring 13 and may further include a receiver for receiving electromagnetic signals from drillstring 13.

In some embodiments, the down hole pressure signals may be processed by surface controller 80. For example, processor 305 may execute a hydraulic model to analyze the pressure data received via communication module 320. Processor 305 may utilize the pressure data to generate a pressure profile along annulus 16. Processor 305 may also be configured to issue commands to other components of the drilling system. For example, processor 305 may issue commands to controllable flow restrictors 8 to modify the pressure profile based on the analysis of the measured pressure data. This may include processor 305 directing communication module 320 to communicate a command to a particular controllable flow restrictor 8 or set of controllable flow restrictors 8 to modify the annular pressure in a certain region along drill string 13. Alternatively, surface controller 80 may modify or control the pressure profile by directing other components besides controllable flow restrictors 8.

Figure 4:
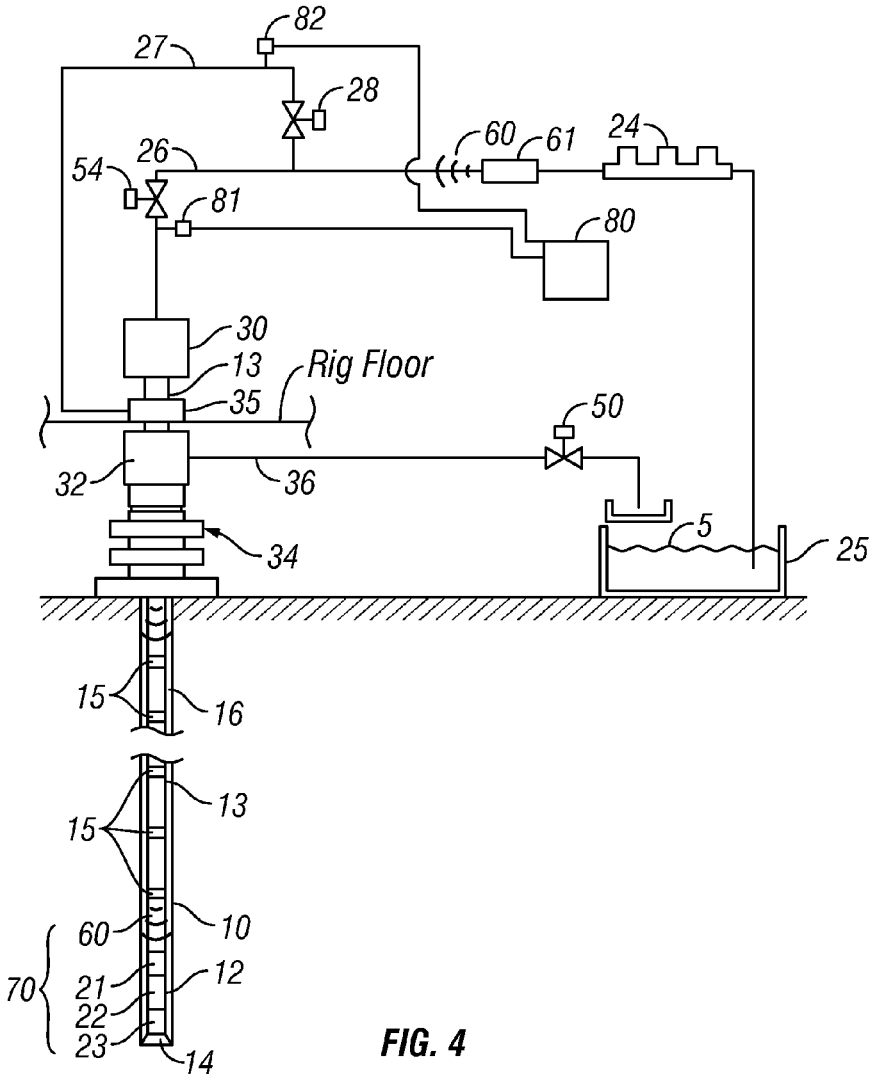
FIG. 4 illustrates an example drilling system, according to aspects of the present disclosure.

FIG. 4 illustrates an alternative example drilling system. As shown in FIG. 4, drill string 13 may be connected to a bottom hole assembly (BHA) 12 comprising a measurement while drilling (MWD) system 70. MWD system 70 may comprise a sensor module 23, a control module 22, and a transmission module 21. A bit 14 may be disposed at the bottom of BHA 12.

Sensor module 23 may be configured to measure any of a variety of drilling characteristics, for example, location, direction of drilling, bottom hole pressure, temperature, or trajectory. Sensor module 23 may be implemented as a plurality of individual components, or as a single component. Sensor module 23 may also be configured to receive signals from other components. For example, when mud pulse telemetry is used, sensor module 23 may sense changes in pressure to detect signals; when acoustic short hop telemetry is used, sensor module 23 may sense acoustic transmissions; when electromagnetic telemetry is used, sensor module 23 may sense electromagnetic transmission; when direct-wired communication is used, sensor module 23 may sense incoming electrical signals.

Transmission module 21 may be configured to transmit signals to one or more other components. For example, transmission module 21 may transmit signals to components at the surface (e.g. surface controller 80), or may transmit signals to components within wellbore 10 (e.g. pressure control modules 15). Transmission module 21 may be configured to communicate via one or a plurality of communication techniques. For example, transmission module 21 may transmit signals via mud pulse telemetry, acoustic short hop telemetry, electromagnetic short hop telemetry, direct wired communication, or other communication means known in the art. Additionally, transmission module 21 may be configured to communicate via multiple means. For example, transmission module 21 may communicate with pressure control modules 15 via acoustic short hop telemetry and communicate with the surface via mud pulse telemetry. These communication means are merely exemplary, and are in no way meant to be limiting.

Control module 22 may be configured to control MWD 70. Control module 22 may include a processor, ASIC, FPGA, or other software, hardware, logic or other means configured to control MWD 70. Control module 22 may be configured to operate sensor module 23 and/or transmission module 21. For example, control module 22 may retrieve data from sensor module 23 and communicate that information to surface controller 80 or some other component at the surface via transmission module 21. It will be appreciated that the components of MWD 70 may merely be logical representations rather than distinct physical components. For example, the entire control module may be implemented as a unitary device, but need not be.

At the surface, drill string 13 may be coupled to a top drive system 30 which may be supported in a drilling derrick (not shown). Drilling fluid 5 may be pumped by pump 24 through standpipe 26 to top drive 30, and to the upper end of drill string 13. The drilling fluid may then flow down drill string 13, exit at bit 14 and return to the surface through annulus 16 between drill string 13 and the wall of wellbore 10. In the example shown, drill string 13 may extend through a rotating drilling head (RDH) 32, then through a blow out preventer (BOP) stack 34 to wellbore 10. RDH 32 may be configured to seal around drill string 13 as it moves into and out of wellbore 10. RDH may also allow rotation of drill string 13 during drilling. RDH 32 may additionally provide a seal to divert the return fluid, under pressure, through a surface return conduit 36 to a controllable choke valve 50, and then to suction pit 25. In some embodiments, surface controller 80 may modify the pressure profile along drill string 13 by operation of choke valve 50. This may be done in response to pressure data transmitted from pressure control modules 15.

As described above, several telemetry techniques may be used to communicate between surface controller 80 and drill string 13. In one example, shown in FIG. 4, mud pulse telemetry may be used. Commands from the surface, for example, from surface controller 80, may be transmitted to pressure control modules 15 or MWD 70 using a surface pulser 61 transmitting pulses 60 down to pressure control modules 15 or MWD 70. Such commands may, for example, direct a pressure control module 15 to adjust a controllable flow restrictor 8 proximate the pressure control module 15 to manage the pressure in a specific zone of wellbore 10. In one example, each pressure control module 15 may comprise a pulse transmitter to transmit pressure readings to surface controller 80. In another example, each pressure control module 15 may transmit a short-hop signal to BHA 12 so transmission module 21 may transmit the information to surface controller 80. In such an embodiment, the short hop signal may be an acoustic signal or the short hop signal may be an electromagnetic signal. In another embodiment, each pressure control module may transmit a short-hop signal to the nearest other pressure control module for retransmission to BHA 12 so transmission module 21 may retransmit the signals to surface controller 80. In embodiments in which mud pulse telemetry is used to transmit signals to surface controller 80, pressure sensor 81 may be configured to detect changes in pressure representing signals being transmitted to surface controller 80. It will be appreciated that pressure sensors 81 and 82 and surface pulser 61 may be part of communication module 320.

In one example, to facilitate transmission of mud pulse signals during connections, a surface continuous circulation device 35 may be used. Continuous circulation device 35 may be configured to allow drill pipe connections to be made up in a pressure sealed chamber such that mud flow may continue to be directed down hole during the connection. As shown in FIG. 4, valve 54 may be closed, and valve 28 opened during a time period when a connection is being made, thereby directing mud flow through conduit 27 to continuous circulation device 35, and then to the down hole systems. Pressure sensor 82 may be used to receive pulses from down hole during connections, while pressure sensor 81 may be used to receive pulses from down hole during drilling. In this way, communication in both directions may continue, even when connections are being made. This may allow pressure control modules 15 to continue to transmit pressure readings to surface controller 80 during connection periods. This may also allow pressure control modules 15 to modify controllable flow restrictors 8 to control pressure of annulus 16 proximate a pressure control module 15 during connection periods. Thus, in some embodiments, mud pulse telemetry may continue even when mud is not being pumped through the main stand pipe, instead being pumped along conduit 27.

While FIG. 4 shows a single surface pulser 61 for both standpipe 26 and conduit 27, in some embodiments surface pulser 61 may be used to transmit signals down hole through standpipe 26 and a separate surface pulser may be used to transmit signals down hole through conduit 27.

Figure 5:
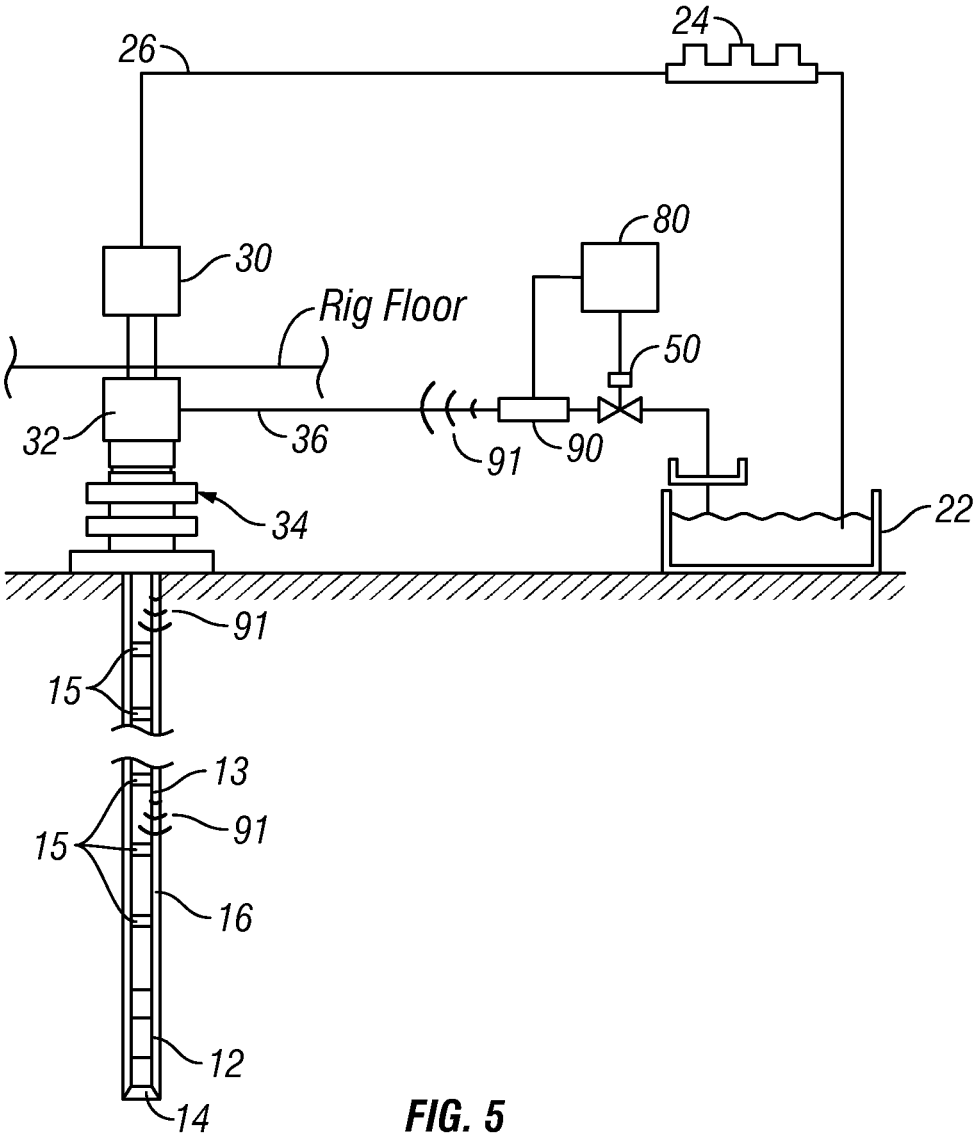
FIG. 5 illustrates an alternative example drilling system, according to aspects of the present disclosure.

In another embodiment, illustrated in FIG. 5, telemetry from the surface to the down hole devices may occur even without a continuous circulation device. Surface controller 80 may be coupled to choke valve 50 and annulus pulser 90. In such an embodiment, even when mud is not being sent down drill string 13, for example, because a connection is being made, surface controller 80 may still be in communication with drill string 13. Annulus pulser 90 may send mud pulse telemetry signals 91 along annulus 16 to any of pressure control modules 15 or BHA 12. For example, surface controller 80 may instruct pressure control modules 15 to prepare to begin transmitting data because drilling operations will resume soon. In another example, surface controller 80 may instruct controllable flow restrictors to change the extent to which they are or will be restricting the flow of mud proximate the controllable flow restrictors. In some embodiments using mud pulse telemetry, choke valve 50 may be closed by surface controller 80 when mud is not being sent down drill string 13, for example, when a connection is being made. In this way, the pressure may be maintained and it may remain a closed loop system such that pulses may continue to travel down annulus 16.

According to one embodiment, a drilling apparatus is disclosed. The drilling apparatus comprises a first pressure control module positioned along a length of the drilling apparatus, the first pressure control module is in communication with a controller and configured to sense pressure proximate the first pressure control module and receive a signal from the controller via mud pulse telemetry while mud is not being pumped through a main standpipe. The drilling apparatus also includes a second pressure control module positioned along the length of the drilling apparatus, the second pressure control module configured to sense pressure proximate the second pressure control module. The drilling apparatus further includes a first controllable flow restrictor positioned along the length of the drilling apparatus, the first controllable flow restrictor configured to alter pressure proximate the first controllable flow restrictor. The drilling apparatus additionally includes a second controllable flow restrictor positioned along the length of the drilling apparatus, the second controllable flow restrictor configured to alter pressure proximate the second controllable flow restrictor.

Alternative disclosed embodiments may include a system comprising a drilling apparatus. The drilling apparatus may include a first pressure control module positioned along a length of the drilling apparatus, the first control module configured to sense pressure proximate the first pressure control module. The drilling apparatus also includes a second pressure control module positioned along the length of the drilling apparatus, the second pressure control module configured to sense pressure proximate the second pressure control module. The drilling apparatus further includes a first controllable flow restrictor positioned along the length of the drilling apparatus, the first controllable flow restrictor configured to alter pressure proximate the first controllable flow restrictor. The drilling apparatus additionally includes a second controllable flow restrictor positioned along the length of the drilling apparatus, the second controllable flow restrictor configured to alter pressure proximate the second controllable flow restrictor. The system may also include a surface controller in communication with the drilling apparatus and configured to receive sensed pressure and transmit commands to at least one of the first and second pressure control modules or the first or second controllable flow restrictors. In such embodiments, the surface controller may be configured to transmit a command via mud pulse telemetry to at least one of the first or second pressure control modules or the first or second controllable flow restrictors while mud is not being pumped through a main standpipe.

Additional embodiments may include a method. The method may include measuring pressure proximate at least one of a plurality of pressure control modules along a drilling apparatus. The method may further include telemetering the measured pressure to a surface controller. The method may also include transmitting a command from the surface controller to at least one of the plurality of pressure control modules or a plurality of controllable flow restrictors via mud pulse telemetry while mud is not being pumped through a main standpipe.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A drilling apparatus comprising:

a first pressure control module positioned along a length of the drilling apparatus, wherein the first pressure control module is in communication with a controller and configured to sense pressure proximate the first pressure control module and receive a signal from the controller via mud pulse telemetry while mud is not being pumped through a main standpipe;

a second pressure control module positioned in a different location than the first pressure control module along the length of the drilling apparatus, the second pressure control module configured to sense pressure proximate the second pressure control module;

a first controllable flow restrictor positioned proximate to the first pressure control module along the length of the drilling apparatus, the first controllable flow restrictor configured to alter pressure proximate the first controllable flow restrictor; and a second controllable flow restrictor positioned proximate to the second pressure control module along the length of the drilling apparatus, the second controllable flow restrictor configured to alter pressure proximate the second controllable flow restrictor.

2. The drilling apparatus of claim 1, wherein the drilling apparatus is connected to a continuous circulation device such that a first valve connected to the main standpipe may be closed and a second valve connected to a conduit may be opened causing mud to continue to flow through the conduit towards a bottom of the drilling apparatus during connection periods of the drilling apparatus.

3. The drilling apparatus of claim 1, wherein the drilling apparatus receives the command via an annular pulser configured to transmit the command through an annulus adjacent the drilling apparatus.

4. The drilling apparatus of claim 1, further comprising a drill bit and wherein one of the first and second pressure sensors is proximate the drill bit.

5. A system comprising:

a drilling apparatus comprising:

a first pressure control module positioned along a length of the drilling apparatus, the first control module configured to sense pressure proximate the first pressure control module;

a second pressure control module positioned a second pressure control module positioned in a different location than the first pressure control module along the length of the drilling apparatus, the second pressure control module configured to sense pressure proximate the second pressure control module;

a first controllable flow restrictor positioned proximate to the first pressure control module along the length of the drilling apparatus, the first controllable flow restrictor configured to alter pressure proximate the first controllable flow restrictor; and a second controllable flow restrictor positioned proximate to the second pressure control module along the length of the drilling apparatus, the second controllable flow restrictor configured to alter pressure proximate the second controllable flow restrictor; and a surface controller in communication with the drilling apparatus and configured to transmit commands to at least one of the first or second pressure control modules or the first or second controllable flow restrictors while mud is not being pumped through a main standpipe and receive sensed pressure.

6. The system of claim 5, wherein the first and the second pressure control modules are configured to communicate directly with the surface controller.

7. The system of claim 5, wherein the drilling apparatus further comprises a bottom-hole assembly including a measurement while drilling apparatus configured to sense pressure proximate the end of the drilling apparatus.

8. The system of claim 7, wherein the bottom-hole assembly is configured to communicate directly with the surface controller and further configured to receive communication from the first and the second pressure sensor modules and transmit those communications to the surface controller.

9. The system of claim 5, further comprising a continuous circulation device configured such that a first valve connected to the main standpipe may be closed and a second valve connected to a conduit may be opened causing mud to continue to flow through the conduit towards a bottom of the drilling apparatus during connection periods of the drilling apparatus.

10. The system of claim 5, wherein pressure along the drilling apparatus is managed by the surface controller such that the pressure along the drilling apparatus is lower than a formation pressure of surrounding formations causing a fluid influx from the surrounding formations.

11. The system of claim 5, wherein pressure along the drilling apparatus is managed by the surface controller such that the pressure along the drilling apparatus is higher than a formation pressure of surrounding formations and lower than a fracture pressure of surrounding formations.

12. The system of claim 5, further comprising a rotating drilling head through which the drilling apparatus passes, the rotating drilling head configured to seal around the drilling apparatus and divert returning mud through a choke valve controllable by the surface controller before returning to a suction pit.

13. The system of claim 12, further comprising an annular pulser configured to transmit commands to the drilling apparatus via an annulus adjacent the drilling apparatus.

14. A method comprising:

measuring pressure proximate at least one of a first and a second pressure control modules positioned at different locations along a length of a drilling apparatus;

telemetering the measured pressure to a surface controller; and transmitting a command from the surface controller via mud pulse telemetry while mud is not being pumped through a main standpipe to at least one of the first and second pressure control modules or a first and second controllable flow restrictors positioned proximate to the first and second pressure control modules to alter pressure proximate at least one of the first or second controllable flow restrictors.

15. The method of claim 14 further comprising closing a first valve connected to the main standpipe and opening a second valve connected to a conduit to cause mud to continue to flow through the conduit towards a bottom of the drilling apparatus during connection periods of the drilling apparatus.

16. The method of claim 15, wherein the command is transmitted via an annular pulser.

17. The method of claim 14, further comprising:

analyzing the measured pressure by the surface controller; and calculating a desired pressure modification to be implemented by at least one of the first and second controllable flow restrictors and the command is configured to implement the desired pressure modification.

18. The method of claim 14, further comprising managing pressure along the drilling apparatus by the surface controller such that the pressure along the drilling apparatus is lower than a formation pressure of surrounding formations causing a fluid influx from the surrounding formations.

19. The method of claim 14, further comprising managing pressure along the drilling apparatus by the surface controller such that the pressure along the drilling apparatus is higher than a formation pressure of surrounding formations and lower than a fracture pressure of surrounding formations.

* * * * *